United States Patent [19]

Borwick

[11] Patent Number: 4,603,724

[45] Date of Patent: Aug. 5, 1986

[54] PET DOOR FOR A SCREEN

[75] Inventor: Michael J. Borwick, Santa Barbara, Calif.

[73] Assignee: Borwick Innovations, Inc., Goleta, Calif.

[21] Appl. No.: 221,347

[22] Filed: Dec. 29, 1980

[51] Int. Cl.[4] ..... E06B 7/28

[52] U.S. Cl. ..... 160/180; 160/380

[58] Field of Search ..... 160/180, 380, DIG. 8, 160/95, 103, 105

[56] References Cited

U.S. PATENT DOCUMENTS

| | | | |
|---|---|---|---|
| 1,684,027 | 9/1928 | Hinman | 160/180 |
| 1,863,014 | 6/1932 | Herndon | 160/95 |
| 2,854,072 | 9/1958 | Winnan | 160/180 |
| 3,220,469 | 11/1965 | Oehmig | 160/380 |
| 3,811,224 | 5/1974 | Garrison | 160/DIG. 8 |
| 3,985,174 | 10/1976 | Bricker | 160/180 |
| 4,047,331 | 9/1977 | Davlantes | 160/DIG. 8 |
| 4,053,007 | 10/1977 | Griffith | 160/180 |

FOREIGN PATENT DOCUMENTS

| | | | |
|---|---|---|---|
| 471910 | 9/1973 | Australia | 160/180 |

*Primary Examiner*—J. Franklin Foss
*Assistant Examiner*—David M. Purol
*Attorney, Agent, or Firm*—Jack C. Munro

[57] ABSTRACT

The locating of a pet door within a screen, such as a screen door. A frame in the form of a molding is composed of a pair of members which are to be tightly clamped together with the screen therebetween. The frame forms an enclosed area. A portion of the screening material within the enclosed area has been removed. Within the enclosed area is swingably mounted a door. The door is to be swingable from a closed position located substantially within the enclosed area to an extended position permitting movement of a domesticated animal through the enclosed area.

4 Claims, 8 Drawing Figures

PET DOOR FOR A SCREEN

BACKGROUND OF THE INVENTION

The field of this invention relates to aperture closures and more particularly to a pet door to permit the pet freedom of movement through a closure, such as a screen door or a screened window.

The use of pet doors within walls and doors has been known for some time. It is convenient for the pet to have his own means of access in and out of a house, so the occupants of the house are not required to see that their animal goes out of doors at the appropriate time. When the animal is not using the door, the door remains closed to protect the inside of the house from the elements, such as rain, cold, heat, dust or wind.

Previous to this invention, it has only been known to locate a pet door within a door or wall. However, it is desirable at certain times, such as the summer months, to have the door open for purposes of circulation. When a door is open, there will be a screen door employed to keep insects from entering the house. Therefore, the prior art pet doors are not usable at this time.

SUMMARY OF THE INVENTION

The primary objective of this invention is to design a pet door within a conventional screen, such as a screen door, or a screened window.

A further objective of this invention is to design a pet door which can be manufactured in kit form and can be easily and quickly installed in a screen enclosure by an unskilled person.

A still further objective of this invention is to have the structure of this invention manufactured inexpensively.

Within a conventional screen, an access opening is made to a desired size by cutting the screen. A frame in the form of elongated molding strips are fixedly secured to the screen directly adjacent the access opening, with the screen being bound between mating pairs of the molding strips. The pet door is located within the access opening and is mounted by a pivot rod to the molding strip. The pet door will normally also include a center screened area. The pet door is to be swingable from a closed position substantially closing the enclosed area to an extended open position permitting movement of the animal through the access opening. The molding members can either comprise a mating pair of metallic members and/or a mating pair of plastic members. A latching means in the form of either a conventional latch or a magnetic latching arrangement is to be employed to maintain the door in the closed position.

DETAILED DESCRIPTION OF THE SHOWN EMBODIMENTS

Figure 1:
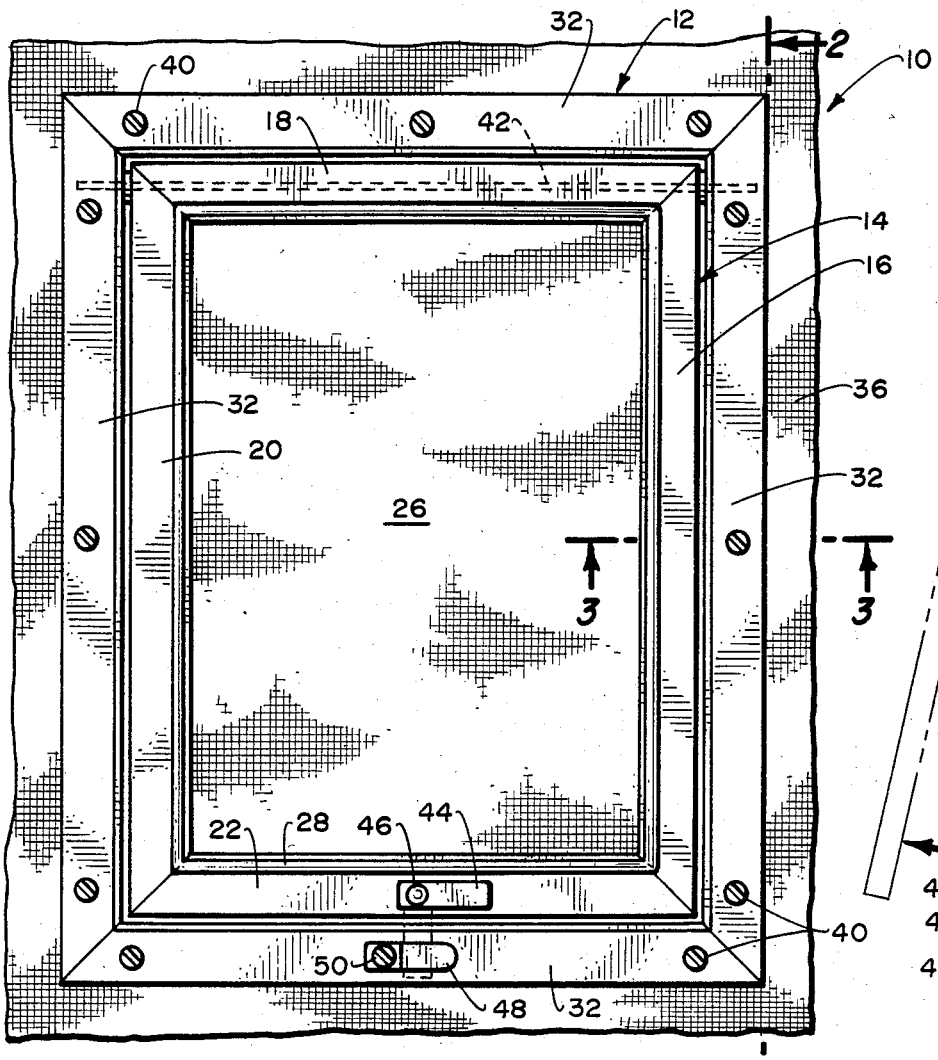
FIG. 1 is a front view of the first embodiment of pet door of this invention showing the door in the closed position.

Referring particularly to the drawings, there is shown in FIG. 1 the first embodiment 10 of this invention which is constructed generally of a fixed frame 12 and a door frame 14. The door frame 14 is constructed of four separate elongated members 16, 18, 20, and 22. The members 16, 18, 20 and 22 are connected together in a substantially rectangular manner. Each of the members 16, 18, 20 and 22 are similar and are merely cut to desired lengths in order to achieve the desired rectangular shape.

Each of the members, 16, 18, 20 and 22 include a groove 24. Within the groove 24 is to be located the peripheral edge of the section of screening 26. Forced into the groove 24 and to tautly hold screening 26 is a resilient strip 28. The resilient strip 28 will normally comprise rubber, or a plastic.

Figure 3:
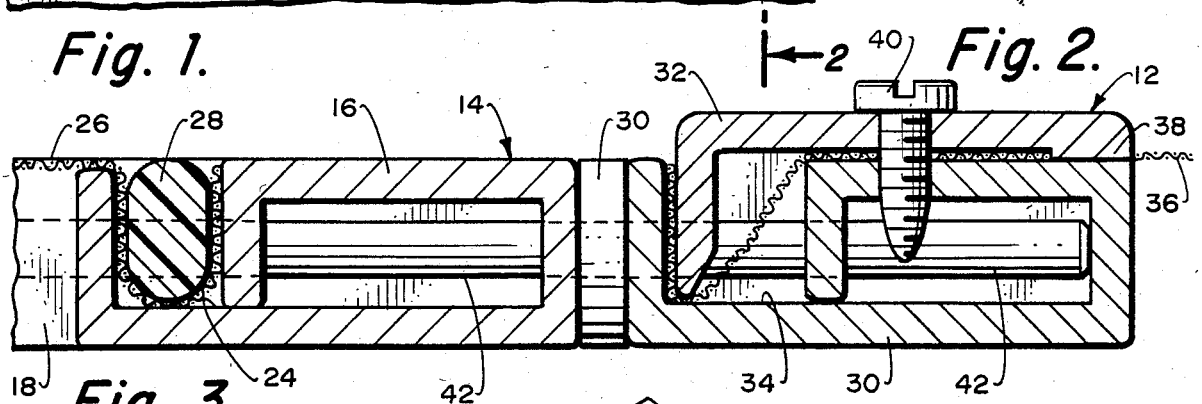
FIG. 3 is a cross-sectional view taken along line 3—3 of FIG. 1.
Figure 4:
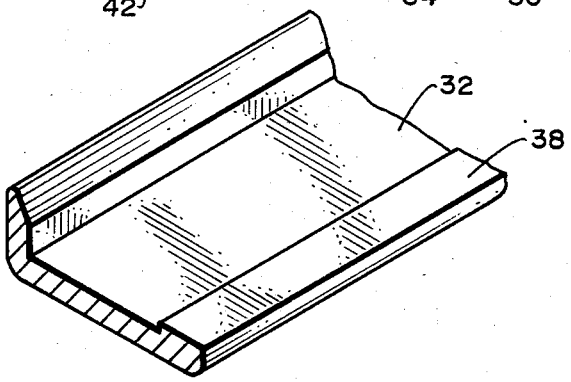
FIG. 4 is an up-side-down, isometric view of one of the male molding members employed within the molding frame of this invention.

The frame 12 is formed of four separate member assemblies connected together in a rectangular arrangement. Each of the member assemblies comprise a female member 30 and a male member 32. Each female member includes an elongated groove 34. Screening material from the screening 36 is conducted into the groove 34, as is clearly shown in FIG. 3 of the drawings. Each male member 32 is substantially L-shaped forming a short leg and a long leg. The short leg of the member 32 is to fit within the groove 34 and tightly bind the screen 36 to the wall of the groove 34. The long leg of the male member 32 includes a flattened ridge 38. The function of the flattened ridge 38 is to bind the screen 36 between the ridge 38 and the portion of the member 30. Conventional fasteners, such as screw fasteners 40, are to be employed to tightly secure the male member 32 in its proper position to the female member 30.

Figure 2:
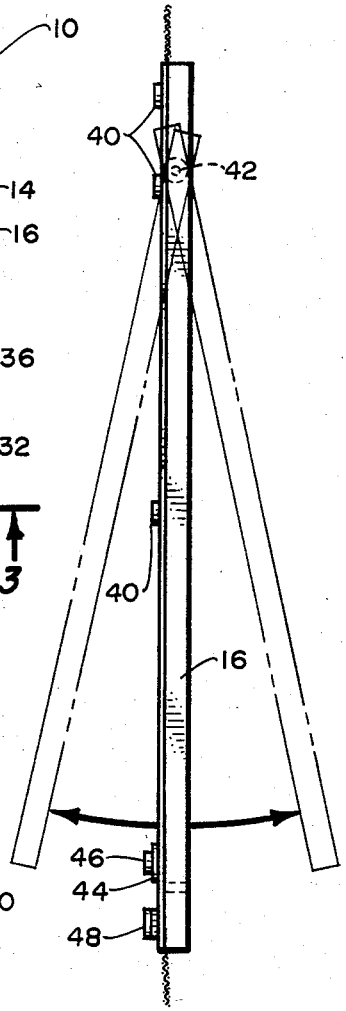
FIG. 2 is a side view of the pet door of this invention taken along line 2—2 of FIG. 1.

Extending entirely through the member 18 is a rod 42. The rod 42 is of a length that it extends beyond the perimeter of the door frame 14. The ends of the rod 42 are to be located within appropriate openings within parallel frame members 30. Also, it is to be noted that an appropriate slot will have to be formed at a desired located within the short leg of the male member 32 so as to provide access for the rod 42. The rod 42 permits the door frame 14 to pivot or swing in respect to the fixed frame 12. The swinging motion is clearly shown within FIG. 2 of the drawings.

Also, it will normally be desirable that a latching means be employed in order to latch the door frame 12 in a closed position when not in use. A conventional latching arrangement, such as a pivotable lever 44, which is mounted by rivet 46 to the member 22, is to engage with offset arm 48 which has been fixedly secured by fastener 50 onto a male member 32. Therefore, movement of the lever 44 to the dotted line position shown within FIG. 1 effectively locks and prevents movement of the door frame 14 with respect to the fixed frame 12.

Referring particularly to FIGS. 5–8 there is shown the second embodiment 52 of this invention which employes a fixed frame 54 and a door frame 56. Both the fixed frame 54 and the door frame 56 are to be constructed of a plastic material. The door frame 56 is constructed of a female member 58 and a male member 60. Each of the members 58 and 60 are constructed as a single integral rectangularly shaped unit defining an enclosed area within which is to be mounted screening 62.

Entirely around the member 58 is located a groove 64 which is formed by a pair of upstanding side walls 66 and 68. It is to be noted that side walls 66 and 68 in their normal at-rest position tend to be inclined toward each other. The periphery of the screening 62 is to extend within the groove 64, as is clearly shown within FIG. 7 of the drawings. Entirely about the male member 60 is located an elongated protuberance 70. The protuberance 70 is to closely interfit within the groove 64 and slightly force apart the upstanding side walls 66 and 68. The interlocking together of the members 58 and 60 in this manner forms an extremely tight single unit with the screen 62 being held in a taut manner within the confines of the door frame 56.

The frame 54 is constructed in a manner similar to the construction of the door frame 56, with it being composed of a rectangularly shaped female member 72 and a rectangularly shaped male member 74. It is to be noted that the rectangular area defined by the connected together members 72 and 74 is slightly larger so as to accommodate the entire door frame 56.

In a manner similar to what was previously described, the female member 72 includes a groove 76, which is formed by a pair of spaced-apart upstanding side walls 78 and 80. To engage with the groove 76 is a protuberance 82. Screening from the enlarged screening section 84 is to be located to within the groove 76. The protuberance 82 is to function to tightly bind a portion of the screening 84 within the groove 76 in between the upstanding side walls 78 and 80. This is also clearly shown within FIG. 7 of the drawings.

Integrally formed at one end of the door frame 56 are a pair of protrusions 86 and 88. The protrusions 86 and 88 are to located respectively within appropriate slots formed within the inside wall 90 of the female member 72. The typical design for such a groove is shown as slot 92 within FIG. 6. The slot 92 is formed within the upstanding wall 80 so as to accommodate the length of the protrusion 86. It is to be noted that the protrusion 86 will protrude within the groove 76 and the length of the male protuberance 70 is selected so as to not interfere with the protrusions 86 and 88.

Each protrusion 86 and 88 is attached to an enlarged section 96 and 98, respectively. These enlarged sections 96 and 98 function to slightly space the door frame 56 from the fixed frame 54 so as to permit easy pivoting or swinging movement of the door frame 56 in respect to the fixed frame 54.

Figure 5:
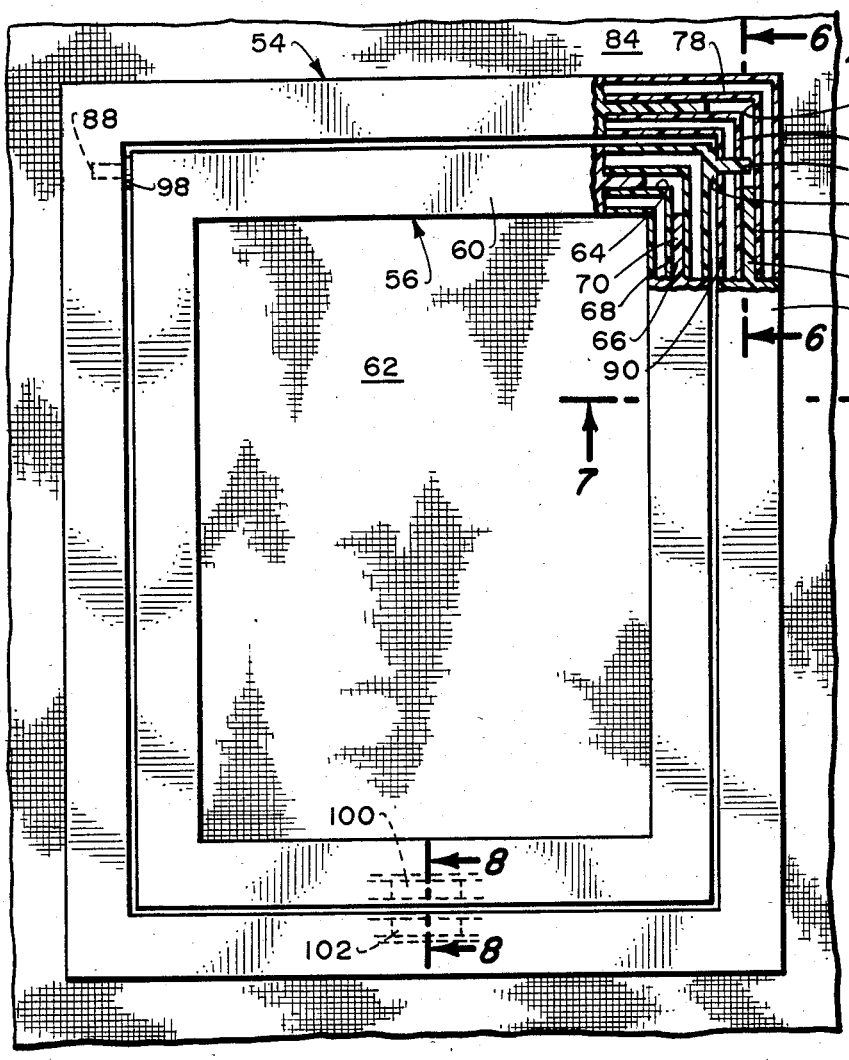
FIG. 5 is a front view, partially cut-away, of a second embodiment of this invention showing the pet door in the closed position.
Figure 6:
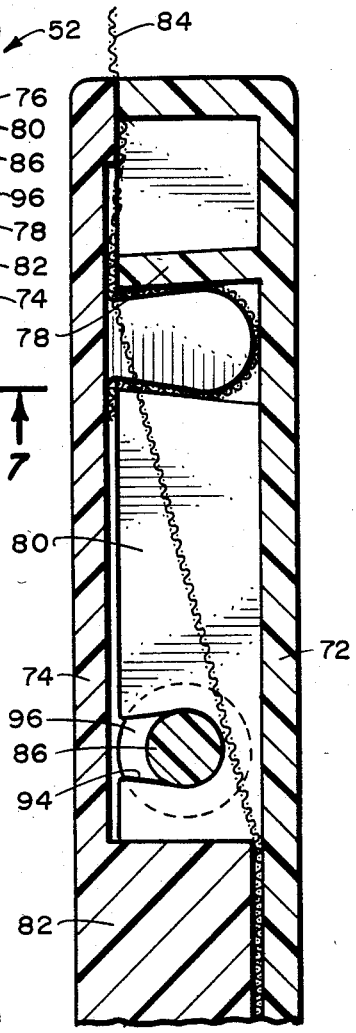
FIG. 6 is a cross-sectional view through a portion of the frame of the pet door of the second embodiment of this invention taken along line 6—6 of FIG. 2.
Figure 7:
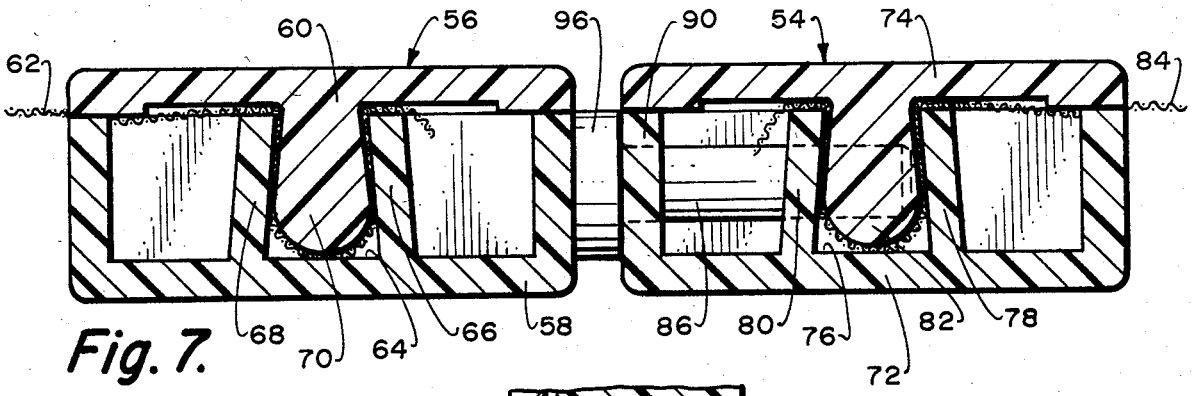
FIG. 7 is a cross-sectional view taken along line 7—7 of FIG. 5.
Figure 8:
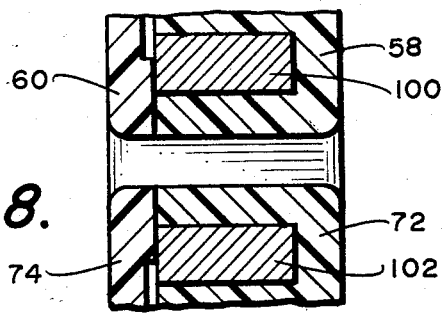
FIG. 8 is a cross-sectional view through a portion of the magnetic latching means employed within the second embodiment of this invention taken along line 8—8 of FIG. 5.

It has also been found to be desirable to incorporate a magnetic latching arrangement between the door frame 56 and the door frame 54. For this purpose, bar magnet 100 is mounted within an appropriate cavity formed within the female member 58, with a similar bar magnet 102 being mounted within a cavity of the female member 72. The bar magnets 100 and 102 are to be located directly adjacent each other with the door 56 closed (as shown in FIG. 5). The magnets 100 and 102 tend to maintain the door frame 56 in the closed position so as to not permit the door frame 56 to be moved by wind, but yet permits the animal to utilize the pet door. Also, it is considered to be within the scope of this invention that a positive form of latching means could be employed, such as is shown as members 44 and 48 within the first embodiment of this invention.

What is claimed is:

1. In combination with a door screen located in a given plane, said door screen having an access opening, a pet door comprising:

a fixed frame forming an enclosed area, said fixed frame being attached only to said screen, said fixed frame comprising a first member and a second member which interfit together securely binding said screen therebetween, said fixed frame being located directly adjacent said access opening with said enclosed area being within said access opening, said first member including an elongated groove formed by a pair of elongated upstanding side wall members, said second member including an elongated protuberance, said elongated protuberance to be located within said elongated groove in a mating male and female arrangement with said upstanding side wall members exerting a continuous bias toward said elongated protuberance and said screen to be located between said side wall members and said elongated protuberance; and a door mounted on said fixed frame and located within said enclosed area, said door being pivotable on said fixed frame on a pivot axis, said pivot axis being located substantially within said given plane, said door to be movable from a closed position located within said given plane to an open position permitting movement of a domesticated animal through said access opening.

2. The combination as defined in claim 1 including:

latching means mounted between said door and said fixed frame, said latching means tending to maintain said door in said closed position.

3. The combination as defined in claim 2 wherein:

said latching means including magnetic latching members.

4. The combination as defined in claim 3 wherein:

said door being constructed principally of screening.

* * * * *